US008894423B2

(12) United States Patent
Mongold et al.

(10) Patent No.: US 8,894,423 B2
(45) Date of Patent: Nov. 25, 2014

(54) CONTACT WITH ANTI-ROTATION ELEMENTS AND SOLDER FLOW ABATEMENT

(71) Applicant: Samtec, Inc., New Albany, IN (US)

(72) Inventors: John Mongold, Middletown, PA (US); Randall Musser, Enola, PA (US); Brian Vicich, Prospect, KY (US); Neal Patterson, Jeffersonville, IN (US)

(73) Assignee: Samtec, Inc., New Albany, IN (US)

( * ) Notice: Subject to any disclaimer, the term of this patent is extended or adjusted under 35 U.S.C. 154(b) by 8 days.

(21) Appl. No.: 13/780,339

(22) Filed: Feb. 28, 2013

(65) Prior Publication Data

US 2014/0242817 A1 Aug. 28, 2014

(51) Int. Cl.

| | |
|---|---|
| ***H01R 12/00*** | (2006.01) |
| ***H01R 13/02*** | (2006.01) |
| ***H01R 13/428*** | (2006.01) |
| ***H01R 13/41*** | (2006.01) |
| ***H01R 12/57*** | (2011.01) |
| ***H01R 13/11*** | (2006.01) |
| *H01R 12/71* | (2011.01) |

(52) U.S. Cl.

CPC ..... *H01R 13/02* (2013.01); *H01R 13/428* (2013.01); *H01R 13/41* (2013.01); *H01R 9/091* (2013.01); *H01R 12/57* (2013.01); *H01R 13/11* (2013.01); *H01R 12/716* (2013.01)

USPC ..... 439/83

(58) Field of Classification Search

USPC ..... 439/83, 78, 736, 874, 876

See application file for complete search history.

(56) References Cited

U.S. PATENT DOCUMENTS

| | | | | |
|---|---|---|---|---|
| 5,791,929 | A | 8/1998 | Banakis et al. | |
| 6,325,644 | B1 * | 12/2001 | Lemke et al. | 439/83 |
| 6,702,594 | B2 | 3/2004 | Lee et al. | |
| 6,969,286 | B1 * | 11/2005 | Mongold et al. | 439/874 |
| 7,377,795 | B2 * | 5/2008 | Vicich et al. | 439/83 |
| 7,837,522 | B1 | 11/2010 | Hoover et al. | |
| 8,052,436 | B1 * | 11/2011 | Ju | 439/83 |
| 2006/0258190 | A1 | 11/2006 | Chen | |
| 2008/0293279 | A1 | 11/2008 | Chen | |
| 2010/0297866 | A1 | 11/2010 | Ju | |

FOREIGN PATENT DOCUMENTS

KR 20-1999-0040289 U 11/1999

OTHER PUBLICATIONS

Official Communication issued in corresponding International Application PCT/US2013/069982, mailed on Feb. 27, 2014.

* cited by examiner

*Primary Examiner* — Neil Abrams
*Assistant Examiner* — Travis Chambers
(74) *Attorney, Agent, or Firm* — Keating & Bennett, LLP

(57) ABSTRACT

A contact includes a head, a tail including an opening, a body connected at one end thereof to the head and at another end thereof to the tail, a first lance and a second lance extending from the body, a dimple raised from the body, and a solder member attached to the tail such that the solder member engages at least a portion of the opening. The first lance and the second lance are arranged to deflect when the contact is inserted into a connector; and the first lance, the second lance, and the dimple are arranged to frictionally secure the contact to the connector.

18 Claims, 18 Drawing Sheets

CONTACT WITH ANTI-ROTATION ELEMENTS AND SOLDER FLOW ABATEMENT

BACKGROUND OF THE INVENTION

1. Field of the Invention

The present invention relates to connectors. More specifically, the present invention relates to connectors with contacts including anti-rotation elements and solder flow abatement.

2. Description of the Related Art

Connectors are used to place electrical devices in communication with one another. A connector includes contacts that transmit signals to an electrical device or another connector. The contacts of a connector may each include a raised portion to help secure and position the contacts within the connector. Further, solder may be attached to the contacts of a connector. The solder is used to form an electrical and mechanical connection between the contact and a pad on a printed circuit board.

U.S. Pat. No. 5,791,929 discloses a conventional contact 110 with raised portions. As shown in FIG. 12 of the present application, the contact 110 includes a head section 111 arranged to engage with a corresponding contact of a device, such as a microprocessor (not shown). The contact 110 includes a pair of positioning feet 114 that are formed on the body section 112 of the contact 110 for increasing the force with which the contact 110 is retained in the connector and to help accurately locate the contact 110 within the connector.

However, the positioning feet 114 of the contact 110 provide only two points of contact for an interference fit with the connector. Accordingly, the contact 110 is only secured in the connector about a center line of the contact 110. Thus, the contact 110 is able to twist or rotate about its center line in the connector. Accordingly, an electrical and mechanical connection between the head section 111 and the corresponding contact of the device may not be sufficiently achieved because the contact 110 may twist or rotate during a connection operation between the connectors. Further, performance of the contact 110 is further reduced if the contact 110 is manufactured to have smaller sizes because smaller positioning feet 114 provide a correspondingly reduced retention force within the connector. Moreover, when a leg 117 of the contact 110 is inserted into a plated through-hole of a printed circuit board (not shown), reflowed solder from the plated through-hole may migrate along the contact 110 and interfere with the positioning feet 114. The contact 110 includes a projection 116 to help prevent wicking of solder when the leg 117 is soldered to the printed circuit board. However, solder may flow along the edges of the contact 110 around the projection 116 to the head section 111.

U.S. Pat. No. 6,702,594 discloses a conventional contact 210 including a solder block 220. As shown in FIG. 13 of the present application, the contact 210 includes a head section 211 arranged to engage with a corresponding contact of a central processing unit (not shown). The contact 210 includes a pair of clip arms 219 that form a clip section in a tail section 213 of the contact 210. The clip arms 219 secure the solder block 220 to the contact 210. When the solder block 220 is reflowed to mount the contact 210 to a printed circuit board, the opening 216 formed in the body section 212 of the contact 210 helps to prevent solder from wicking up the contact 210.

However, because the opening 216 is located in the body section 212, and thus separated from the tail section 213 and the pair of clips arms 219, solder can flow up the contact and away from the tail section 213 to the head section 211 when the solder block 220 is reflowed. The opening 216 can be insufficient to prevent solder from wicking up the contact 210 if the volume of reflowed solder is large or if the contact 210 is passed through a reflow oven multiple times. Accordingly, when the connector that includes the contact 210 is mounted to a printed circuit board, the contact 110 may have an insufficient electrical and mechanical connection with a corresponding pad of the printed circuit board if an excessive amount of solder flows up the contact 210. In particular, an insufficient amount of solder may be present between the tail section 213 and the corresponding pad of the printed circuit board. Further, due to the geometry of the opening 216, reflowed solder may migrate over the sides of the opening 216 and to the outer edges of the contact 210. The reflowed solder may also interfere with the head section 211.

SUMMARY OF THE INVENTION

To overcome the problems described above, preferred embodiments of the present invention provide a contact with anti-rotation features and solder flow abatement.

A contact according to a preferred embodiment of the present invention includes a head, a tail including an opening, a body connected at one end thereof to the head and at another end thereof to the tail, a first lance and a second lance extending from the body, a dimple raised from the body, and a solder member attached to the tail such that the solder member engages at least a portion of the opening. The first lance and the second lance are arranged to deflect when the contact is inserted into a connector; and the first lance, the second lance, and the dimple are arranged to frictionally secure the contact to the connector.

The solder member is preferably crimped to the tail. The opening preferably includes a holding section at an end of the tail opposite to the body, and the solder member is preferably attached to the tail such that the solder member fills the holding section. The opening preferably includes an abatement section extending in a direction of the body, and the solder member is preferably attached to the tail such that the solder member does not engage with the abatement section before the solder member is reflowed. The abatement section is preferably arranged such that the solder member reflows into the abatement section when the solder member is reflowed.

The first lance, the second lance, and the dimple are preferably arranged so as to not be co-linear. The first lance, the second lance, and the dimple are preferably arranged to be equidistant or substantially equidistant. The contact preferably includes a second dimple, and the first lance, the second lance, the dimple, and the second dimple are preferably arranged at or substantially at vertices of a square or rectangle. Alternatively, the first lance, the second lance, the dimple, and the second dimple are preferably arranged at or substantially at vertices of a parallelogram or trapezoid.

The tail preferably includes a first leg and a second leg extending therefrom; a space between the first leg and the second leg preferably defines at least a portion of the opening; and the solder member is preferably attached to the first leg and the second leg.

The contact preferably includes an abatement band extending across each of an opposing pair of major surfaces of the contact. The abatement band is preferably formed either by depositing a material that solder does not adhere to on the major surfaces of the contact or by scoring the major surfaces of the contact.

The contact is preferably included in a connector, and the connector preferably includes a plurality of contacts. The head of each of the contacts is preferably arranged to engage with a corresponding contact of another connector. The solder member of each of the contacts is preferably arranged to be fused to the tail of the contact and to be fused with a pad on a printed circuit board.

A contact according to a preferred embodiment of the present invention includes a head, a tail including a continuous opening with a holding section and an abatement section, a body connected at one end thereof to the head and at another end thereof to the tail, and a solder member attached to the tail such that the solder member engages the holding section. The abatement section is arranged such that the solder member reflows into the abatement section when the solder member is reflowed.

The abatement section is preferably arranged to have a volume proportional to a volume of the solder member.

The above and other features, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described in detail with reference to FIGS. 1A to 11. Note that the following description is in all aspects illustrative and not restrictive, and should not be construed to restrict the applications or uses of the present invention in any manner.

Figure 1A:
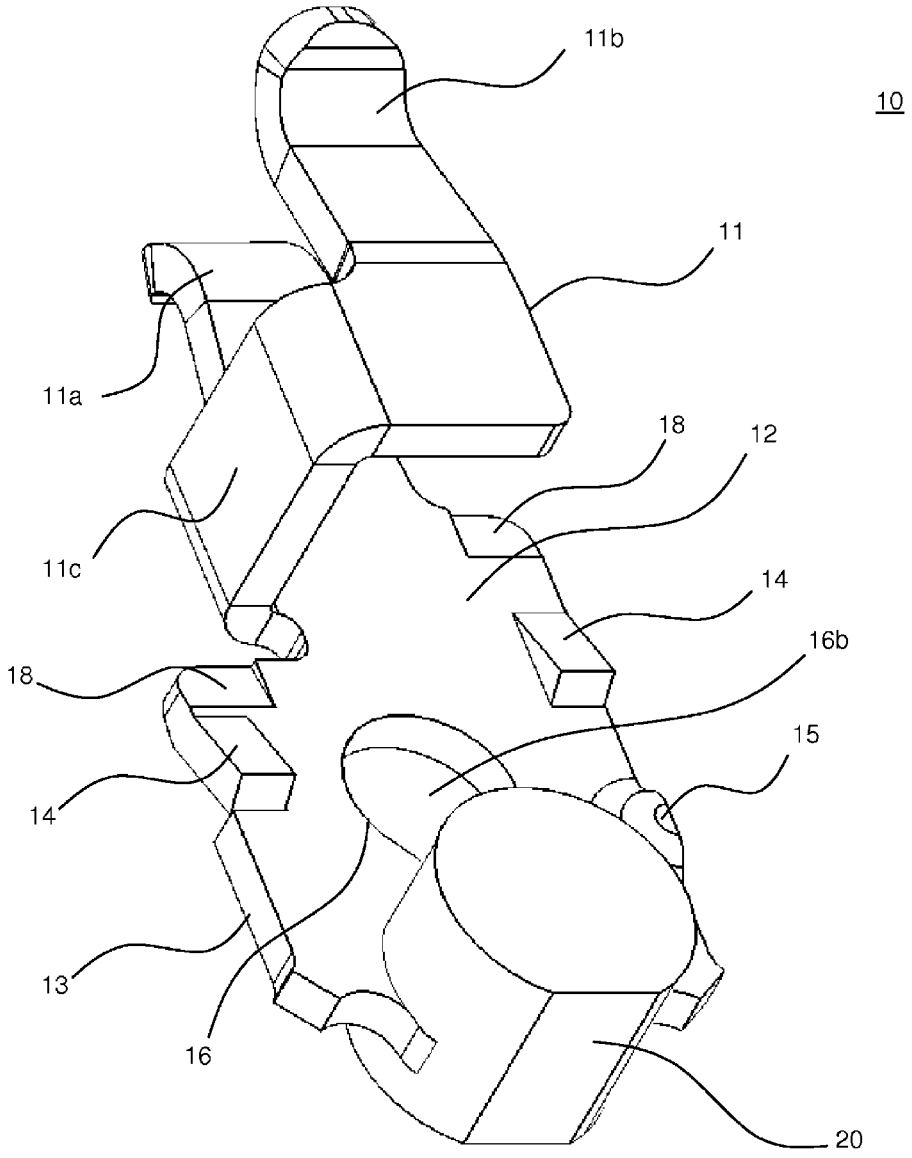
FIG. 1A is a front perspective view of a contact with a solder member according to a preferred embodiment of the present invention.
Figure 1B:
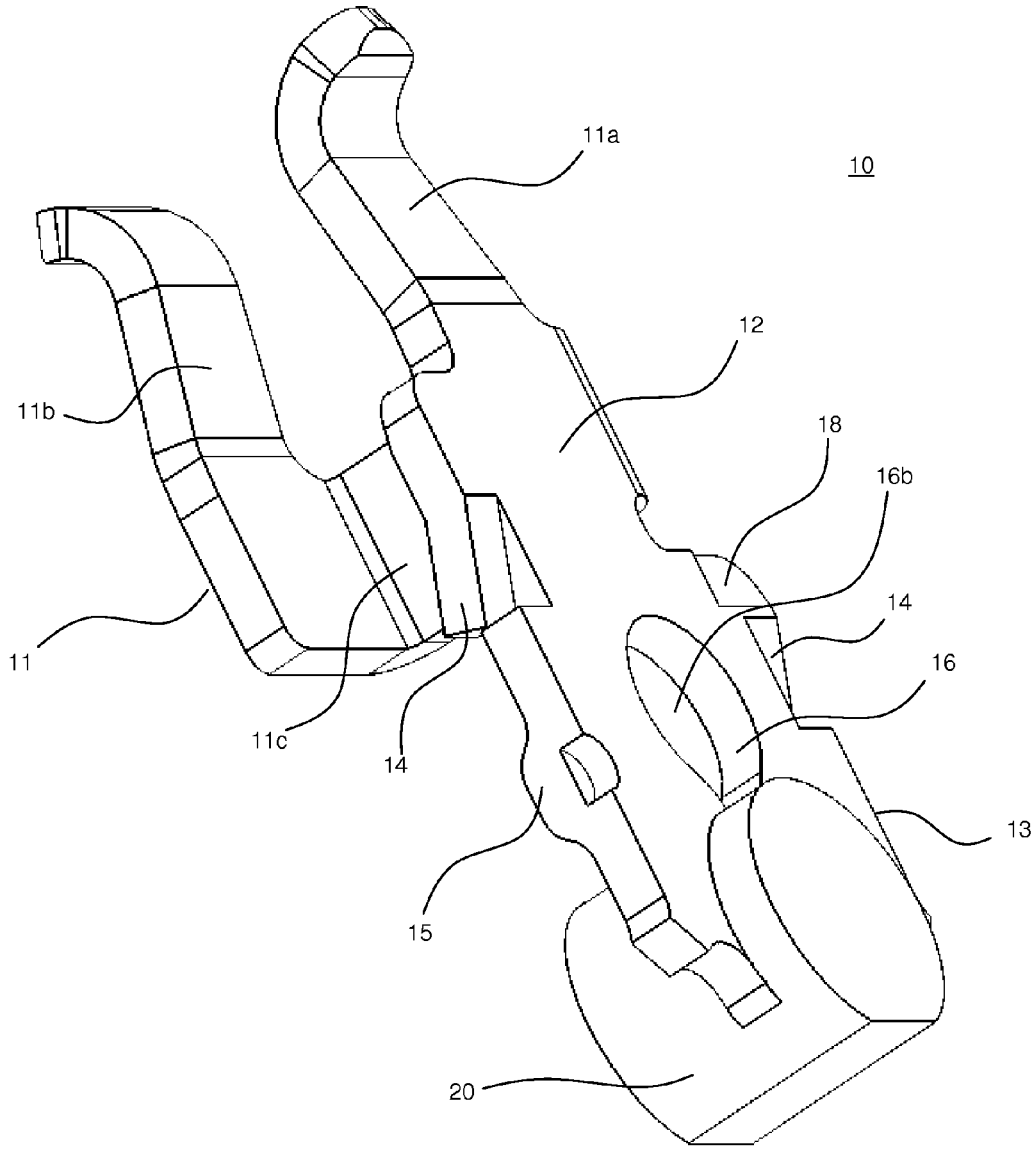
FIG. 1B is a rear perspective view of the contact shown in FIG. 1A.
Figure 2A:
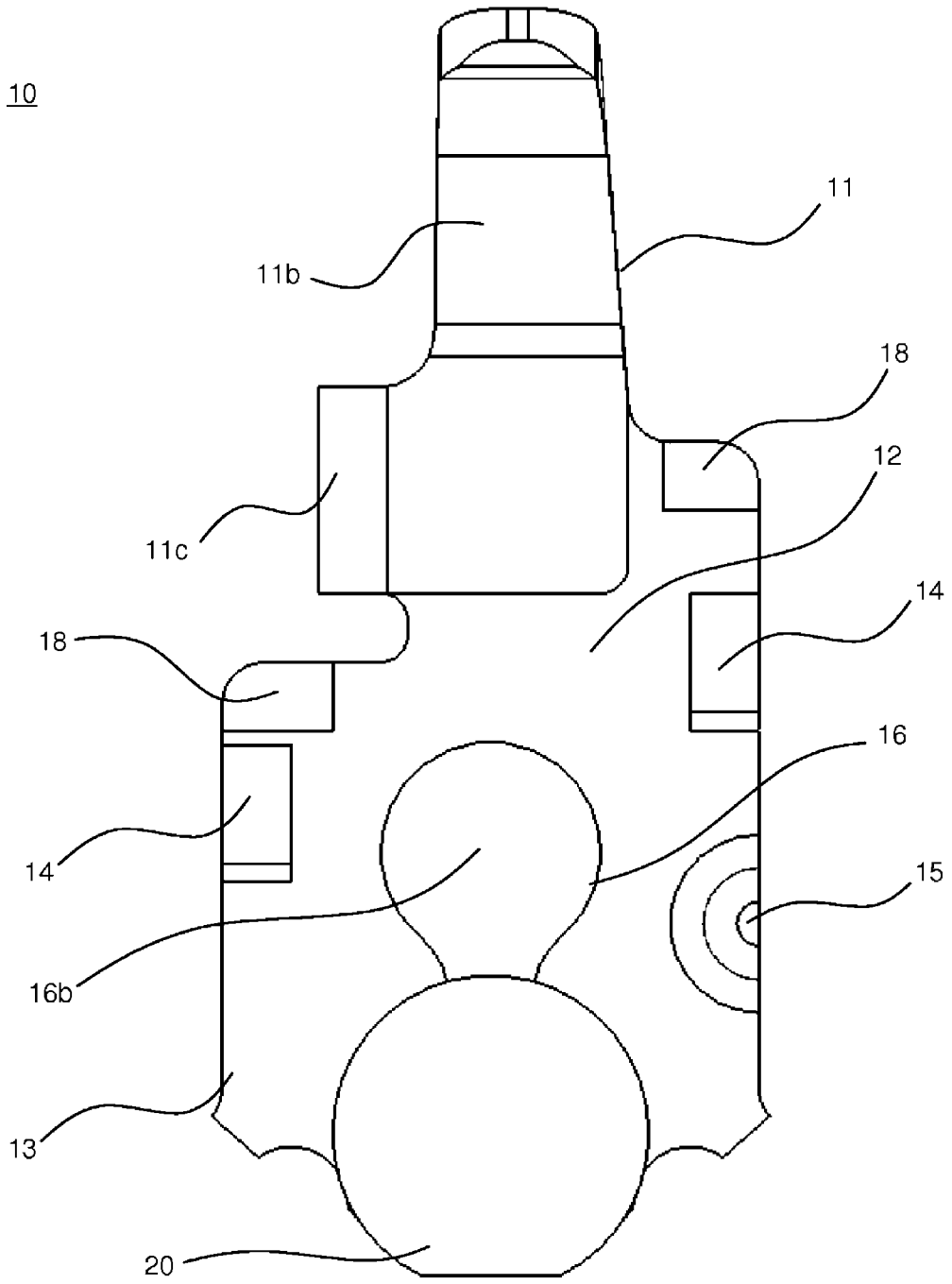
FIG. 2A is a front view of the contact shown in FIG. 1A.
Figure 2B:
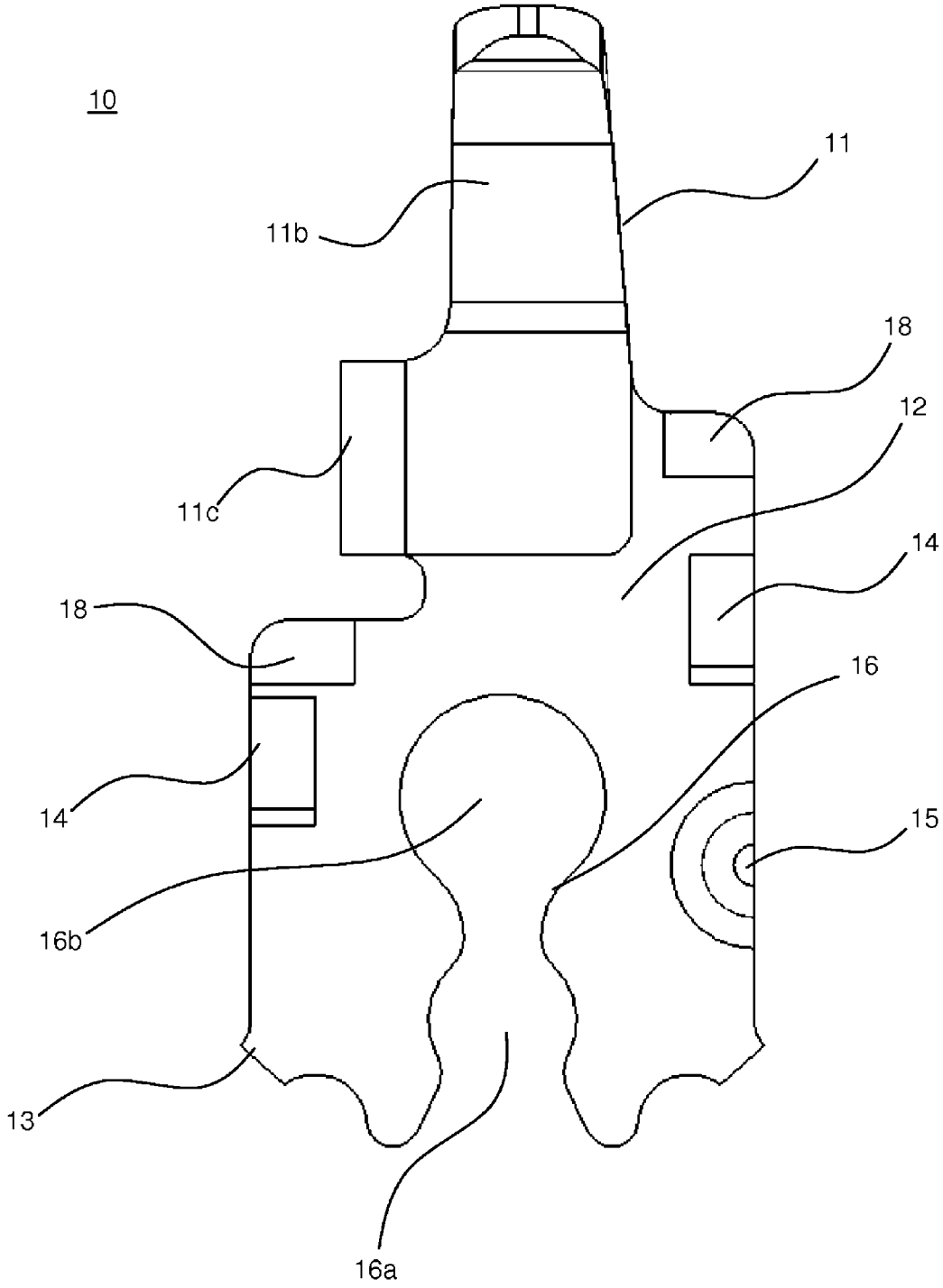
FIG. 2B is a front view of the contact shown in FIG. 1A without the solder member.
Figure 3:
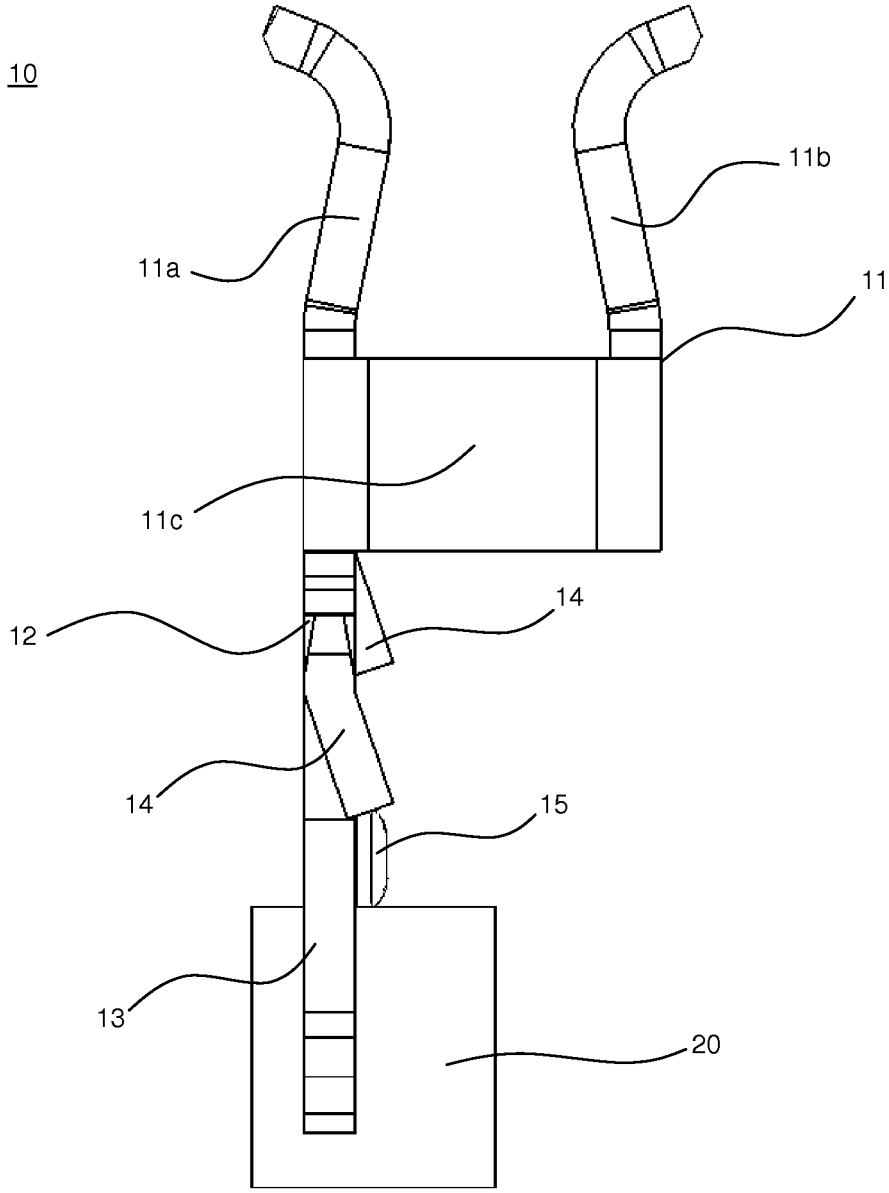
FIG. 3 is a side view of the contact shown in FIG. 1A.
Figure 4:
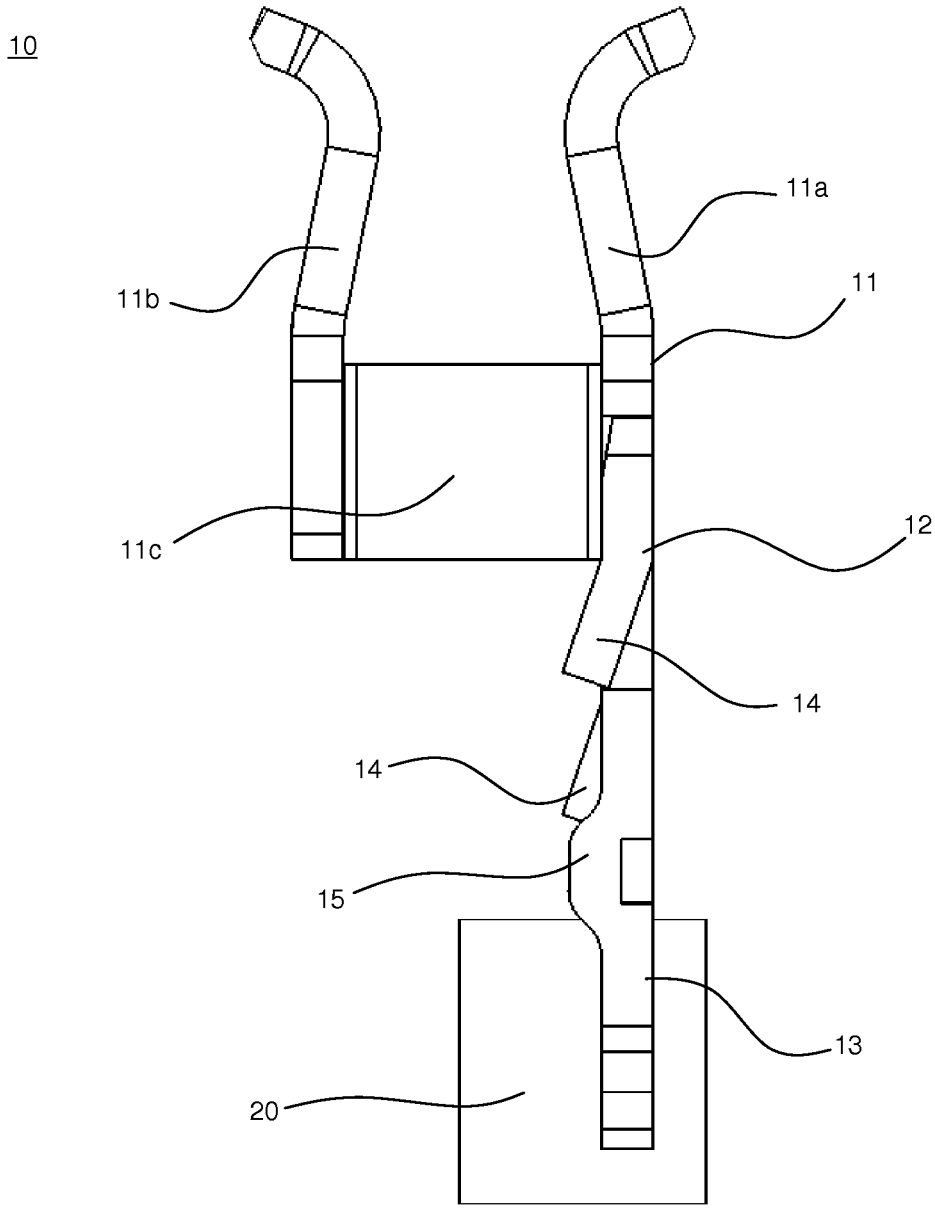
FIG. 4 is another side view of the contact shown in FIG. 1A.

FIGS. 1A to 4 show a contact 10 with a solder member 20 in accordance with a preferred embodiment of the present invention. FIGS. 1A and 1B are front and rear perspective views of the contact 10 with the solder member 20. FIG. 2A is a front view of the contact 10 with the solder member 20, and FIG. 2B is a front view of the contact 10 without the solder member 20. FIGS. 3 and 4 are side views of the contact 10 with the solder member 20.

As shown in FIGS. 1A to 4, the contact 10 includes a head section 11, a body section 12, and a tail section 13. The head section 11 is connected to one end of the body section 12, and the tail section 13 is connected to the other end of the body section 12. The contact 10 includes two lances 14 that extend from the body section 12, a dimple 15 that protrudes from the body section 12 or the tail section 13, and an opening 16 that is located in the tail section 13. The head section 11 includes a first arm 11*a*, a second arm 11*b*, and a bridge 11*c* that connects the second arm 11*b* to the first arm 11*a* so as to define a tulip connection point for the contact 10.

As shown in FIG. 2B, without the solder member 20, the opening 16 includes two expanded portions, a holding section 16*a* and an abatement section 16*b*. Preferably, the holding section 16*a* and the abatement section 16*b* are formed as a continuous notch in the contact 10. The holding section 16*a* is arranged to receive the solder member 20, and the solder member 20 is preferably crimped to the electrical contact 10 at the holding section 16*a*. The abatement section 16*b* may extend from the tail section 13 into the body section 12.

Preferably, the contact 10 includes two lances 14 and a dimple 15 to secure the electrical contact 10 in the connector 30 by a frictional, interference fit. The lances 14 are preferably arranged to deflect when the contact 10 is inserted into the connector 30, whereas the dimple 15 is preferably arranged to not deflect (i.e., to retain its shape) when the contact 10 is inserted into the connector 30. The contact 10 preferably includes recessed shoulders 18 to facilitate insertion and alignment of the contact 10 when the contact 10 is inserted into the connector 30. Further, any other number of lances 14 or dimples 15 can also be used. One or more of the lances 14 may be replaced with a dimple 15, or vice-versa. The lances 14 and the dimple 15 are preferably arranged to engage with the connector 30 such that contact 10 is secured in the connector 30. It is also possible to use other structures, e.g., side barbs extending in the width direction of the contact 10, to secure the contact 10 in the connector 30.

As shown in FIGS. 1A to 2B, three points of contact between a connector and the contact 10, as provided by the lances 14 and the dimple 15, help prevent pivoting or rocking of the contact 10 about a centerline of the contact 10. Further, the frictional fit provided by the lances 14 and the dimple 15 helps prevent the head section 11 from moving during engagement with a corresponding contact, a printed circuit board, or other electrical device. The frictional fit also allows the contact 10 to be securely connected when a "floating beam" connection point is used, as shown by the second arm 11*b* in FIGS. 1A to 4, and to increase contact density or to reduce pitch spacing in a connector that includes the contact 10. The lances 14 and the dimple 15 are preferably arranged so as to not be co-linear, and, more preferably, arranged to be equidistant or substantially equidistant within manufacturing tolerances, i.e., at or near the vertices of an equilateral triangle.

During the soldering process, the solder member 20 reflows so that some of the solder member 20 migrates into the abatement section 16*b* of the contact 10 so that the solder member 20 is retained at the tail section 13 near the central longitudinal axis of the connector 10. The tail 13 of the contact 10 is preferably arranged to be connected to a printed circuit board by fusing the solder member 20 to the tail 13 of the contact 10 and to a pad on the printed circuit board. Preferably, a mechanical and electrical connection is formed between the contact 10 and the printed circuit board by reflowing the solder member 20 to fuse the tail 13 of the contact 10 to the pad on the printed circuit board.

The abatement section 16*b* is preferably dimensioned such that the size of the opening 16 is proportional to the amount of solder required to achieve an acceptable electrical and mechanical connection between the contact 10 and a corresponding pad on a printed circuit board. Preferably, the volume of the opening 16 is proportional to the volume of the solder member 20. Further, the shape of the holding section 16*a* and the abatement section 16*b* may be modified in order to set a particular upper limit for solder flow on the contact 10.

Figure 5A:
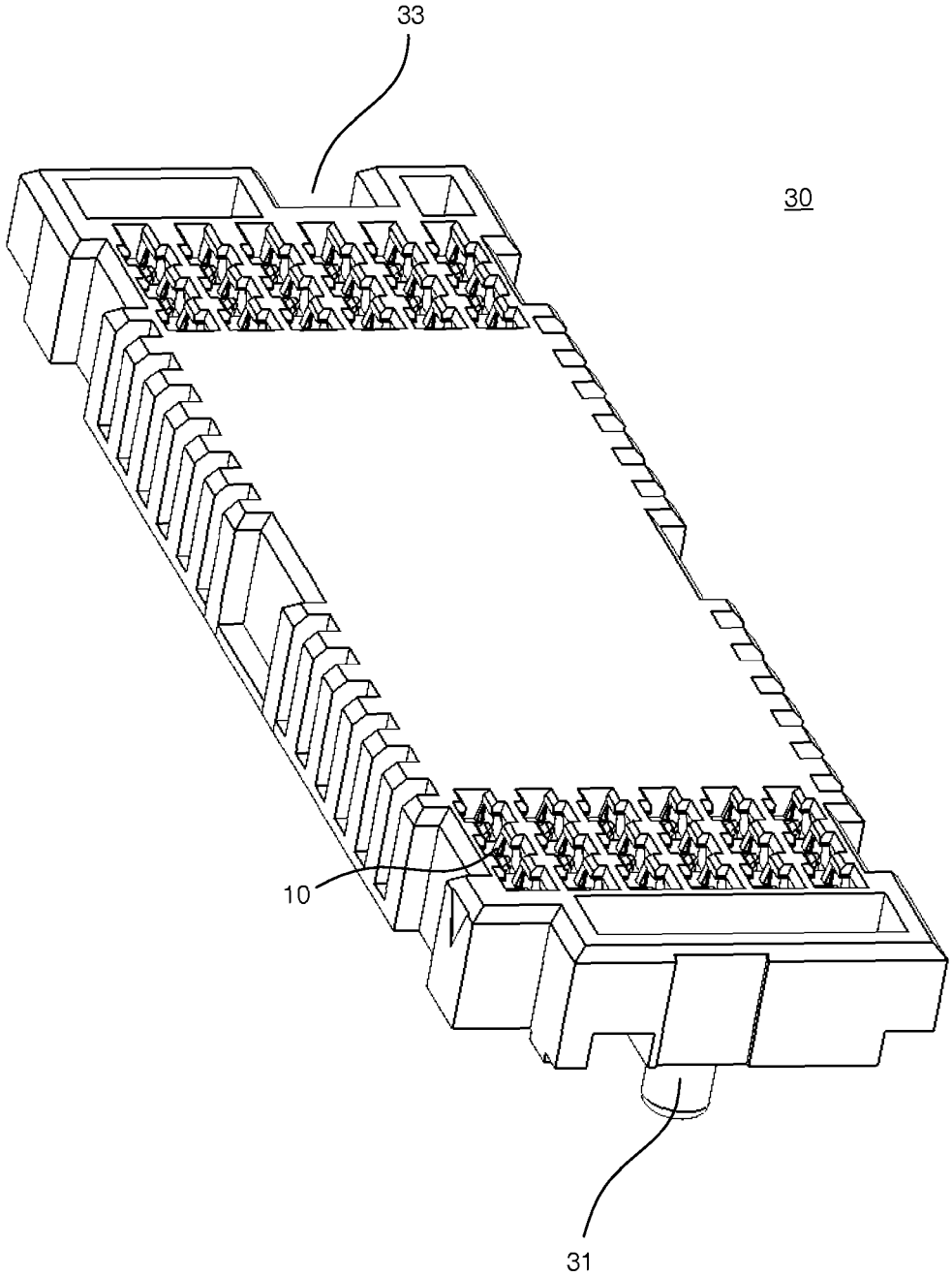
FIG. 5A is a top perspective view of a connector according to a preferred embodiment of the present invention.
Figure 5B:
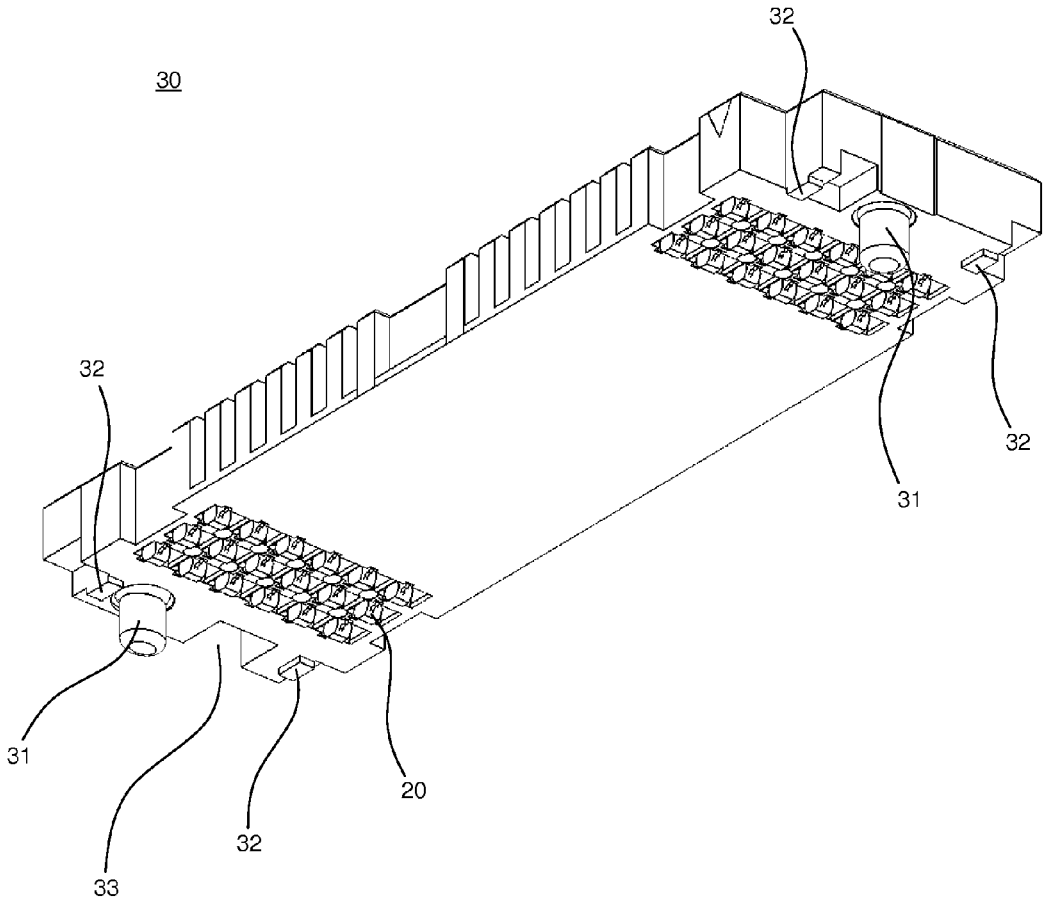
FIG. 5B is a bottom perspective view of the connector shown in FIG. 5A.
Figure 6:
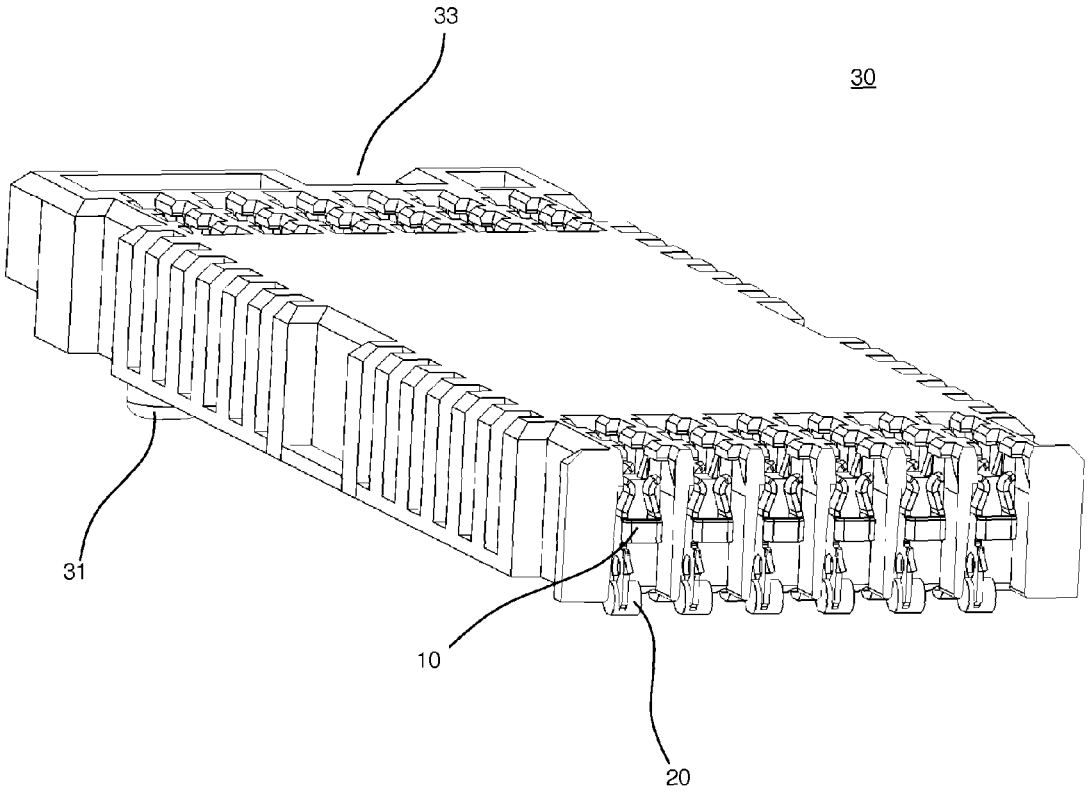
FIG. 6 is a perspective cross-sectional view of the connector shown in FIG. 5A.
Figure 7:
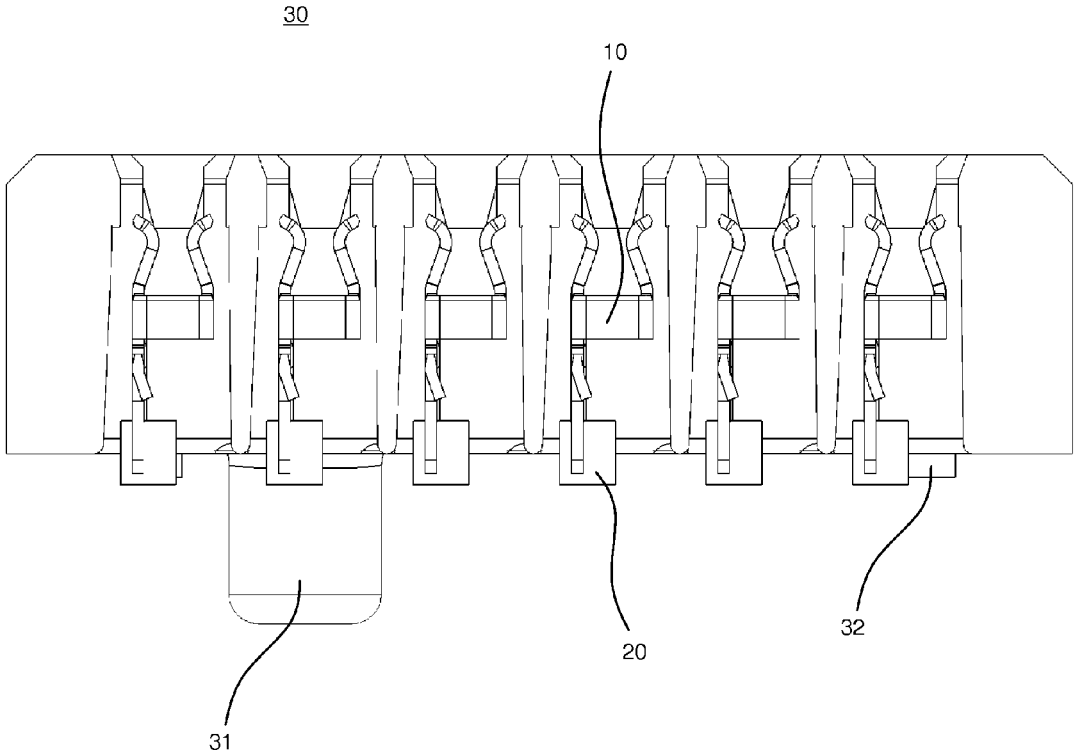
FIG. 7 is a side cross-sectional view of the connector shown in FIG. 5A.

FIGS. 5A to 7 show a connector 30 that includes a plurality of contacts 10 with solder members 20 in accordance with a preferred embodiment of the present invention. FIGS. 5A and 5B are perspective views of a connector 30. FIG. 6 is a perspective cross-sectional view of the connector 30. FIG. 7 is a side cross-sectional view of the connector 30. The connector 30 is preferably a female connector, as shown in FIGS. 5A to 7, and is preferably arranged to engage with a corresponding male connector.

As shown in FIGS. 5A to 7, the connector 30 preferably includes a plurality of the contacts 10 with corresponding solder members 20. Contacts 10 and solder members 20 are not shown in a central portion of the connector 30 for clarity. Preferably, the contacts 10 are arranged along substantially the entire length and width of the connector 30, for example.

As shown in FIGS. 5A to 7, the connector 30 preferably includes at least one alignment pin 31. The alignment pin 31 is used to guide the connector 30 to the proper location and proper orientation on a printed circuit board (not shown) to which the connector 30 is mounted. Further, as shown in FIGS. 5B and 7, the connector 30 preferably includes standoffs 32 to space the connector 30 from the printed circuit board to help ensure proper solder setting during reflow of the solder members 20 and to reduce mechanical stress on the contacts 10. Preferably, the connector 30 preferably includes a polarization key 33 to ensure proper orientation when engaging with a corresponding connector.

Figure 8:
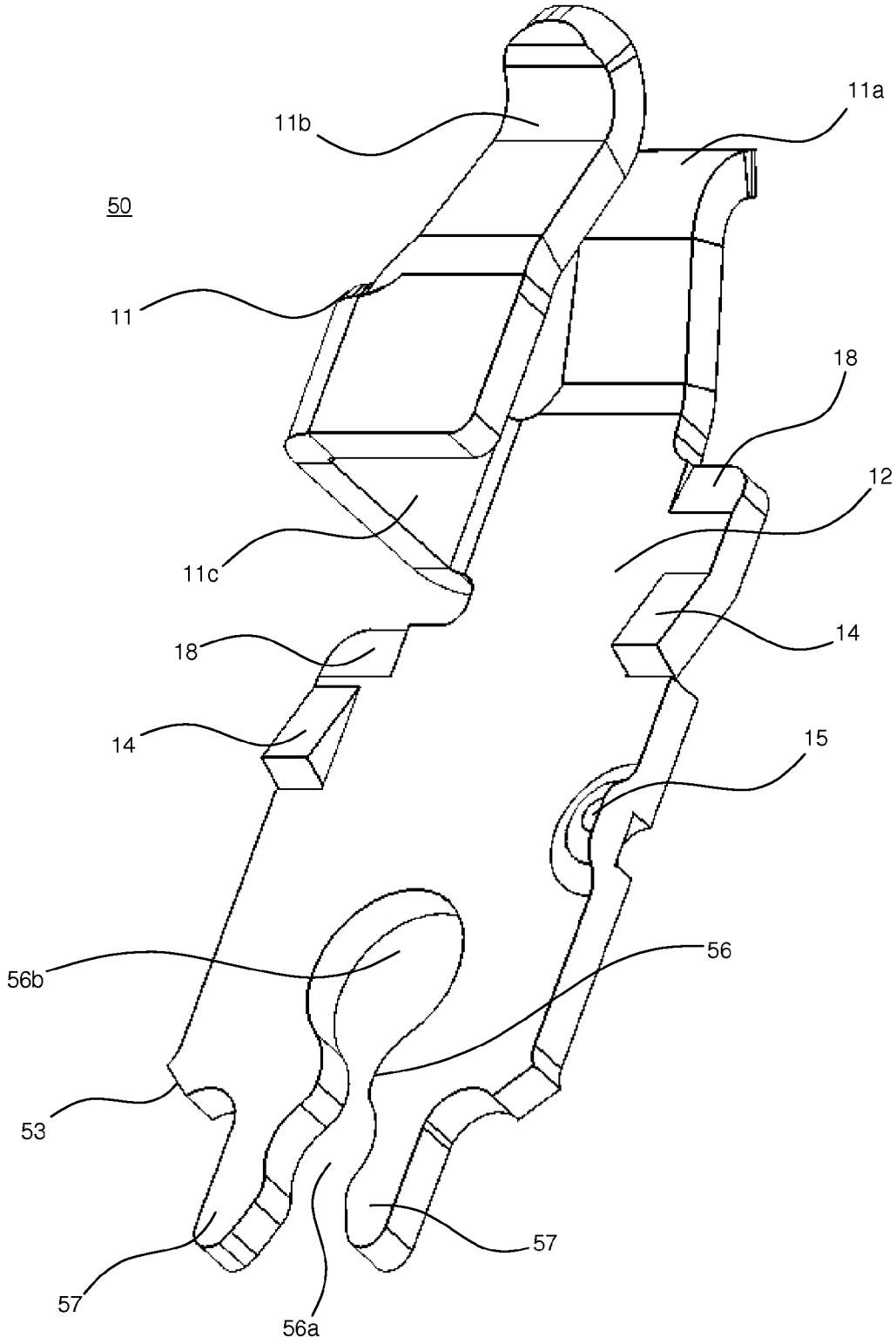
FIG. 8 is a perspective view of a contact according to a preferred embodiment of the present invention.
Figure 9A:
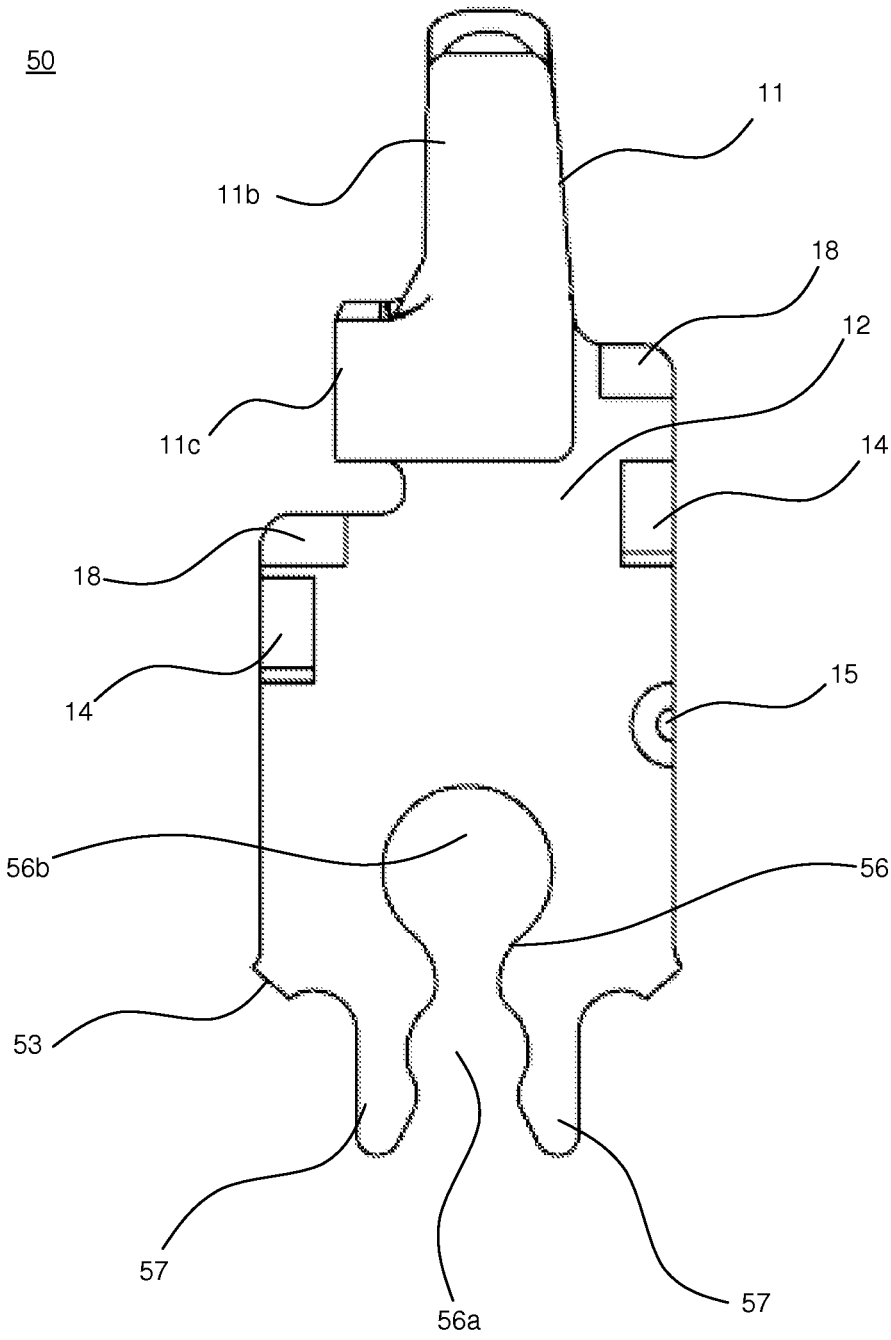
FIG. 9A is a front view of the contact shown in FIG. 8.
Figure 9B:
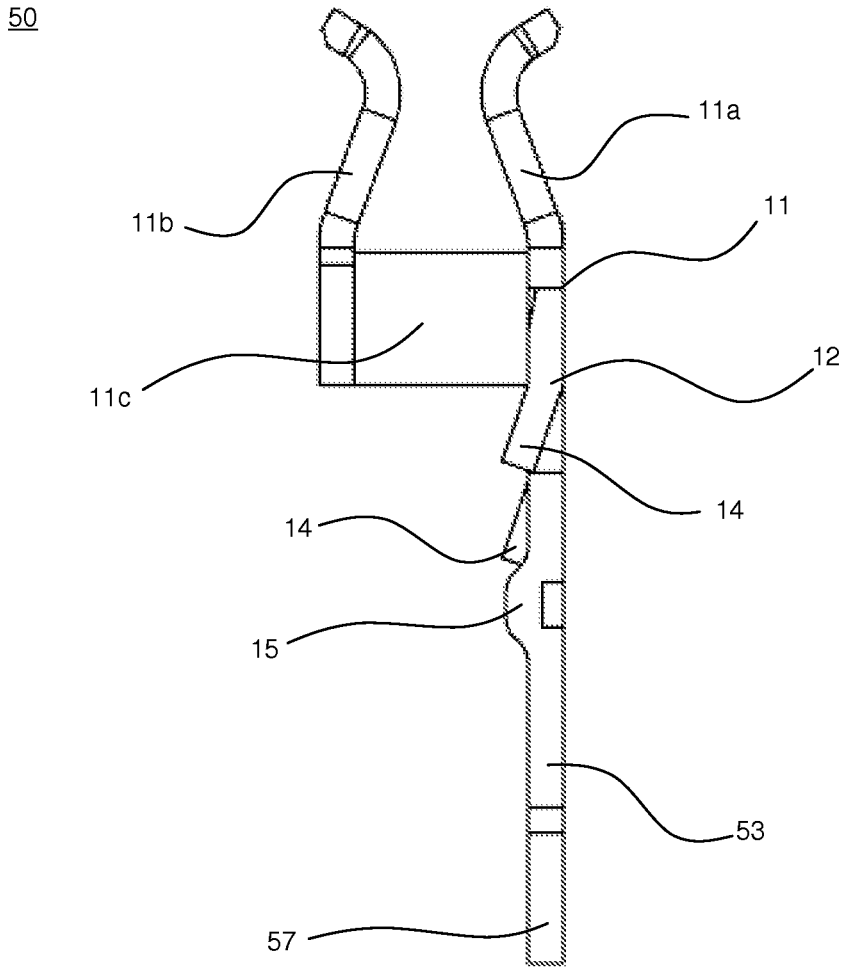
FIG. 9B is a side view of the contact shown in FIG. 8.

FIGS. 8 to 9B are, respectively, a perspective view, a front view, and a side view of a contact 50 in accordance with a preferred embodiment of the present invention. The contact 50 includes a pair of legs 57 that allow the opening 56 to be moved down the contact 50 as compared to the opening 16 of the contact 10. As shown in FIGS. 8 to 9B, the contact 50 preferably includes features similar to the contact 10 shown in FIGS. 1A to 4, including a head section 11 (with a first arm 11*a*, a second arm 11*b*, and a bridge 11*c*), body section 12, lances 14, dimple 15, and recessed shoulders 18 as the contact 10 shown in FIGS. 1A to 4. Accordingly, further discussion of these elements will be omitted. The contact 50 is preferably included in a female connector similar to connector 30 as shown in FIGS. 5A to 7, and is preferably arranged to engage with a corresponding male connector.

As shown in FIGS. 8 to 9B, the contact 50 includes an extended tail section 53 with the two legs 57 extending therefrom. Preferably, the opening 56 of the contact 50 is similar to the opening 16 of the contact 10 shown in FIGS. 1A to 4. However, the opening 56 is preferably arranged such that a holding section 56*a* of the opening 56 is disposed between the legs 57 of the tail section 53. A solder member 20 may be attached to the contact 50 at the holding section 56*a* in a similar manner as described above with regard to the holding section 16*a* of the connector 10 shown in FIGS. 1A to 4. It is noted that the solder member 20 has been omitted from FIGS. 8 to 9B for clarity. Further, the abatement section 56*b* of the opening 56 is preferably arranged such that the lances 14 and the dimple 15 are each at least partially located at a higher position than the abatement section 56*b*.

Accordingly, by increasing the distance between the opening 56 and the head section 11, the tail section 53 of the contact 50 helps to prevent solder from wicking up the contact 50 and interfering with the head section 11, the lances 14, and the dimple 15. Thus, the contact 50 may be securely retained within a connector (not shown) that includes the contact 50, while further reducing the likelihood that reflowed solder will interfere with the head section 11, the lances 14, or the dimples 15.

Figure 10:
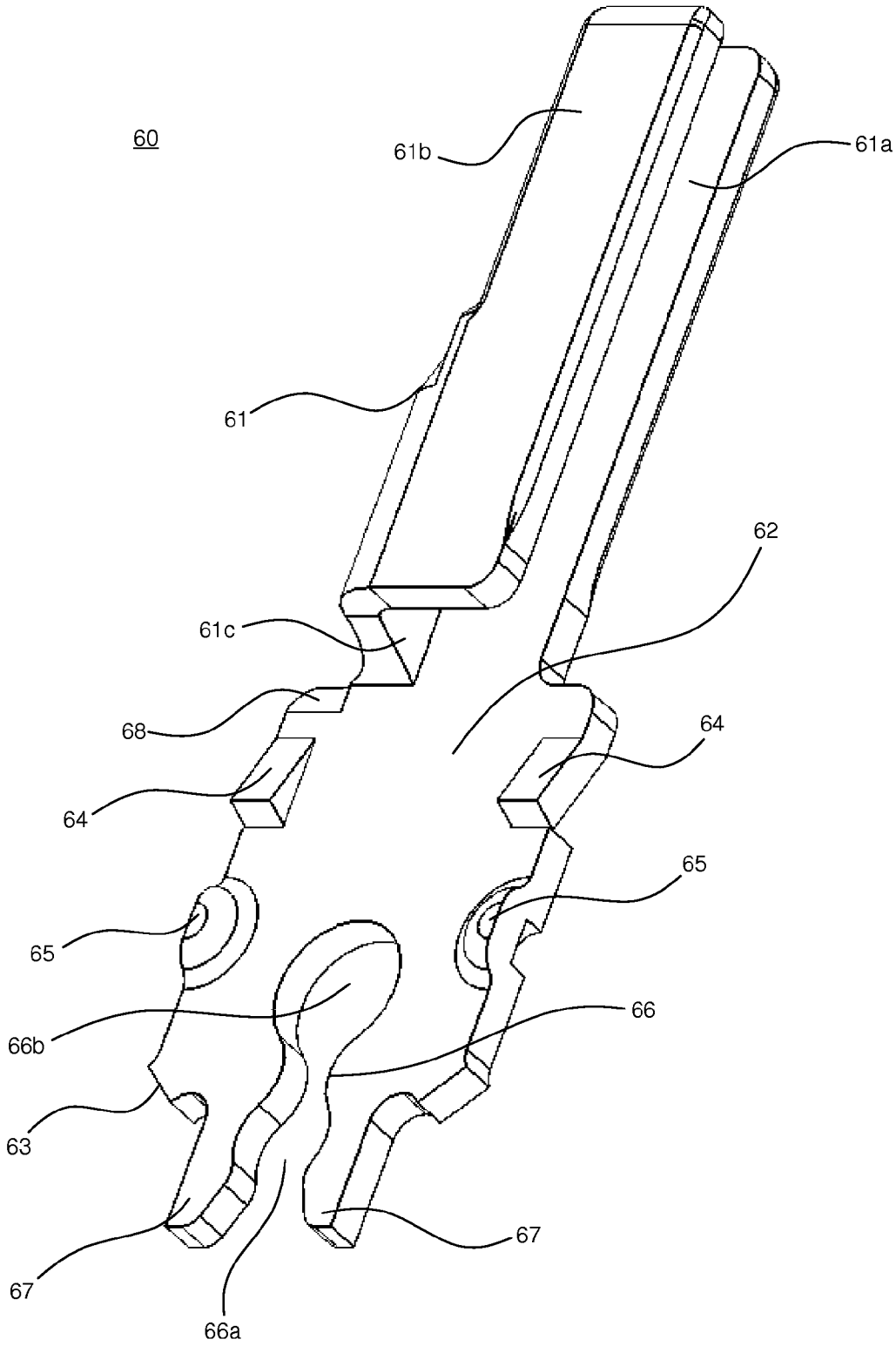
FIG. 10 is a perspective view of a contact according to a preferred embodiment of the present invention.
Figure 11A:
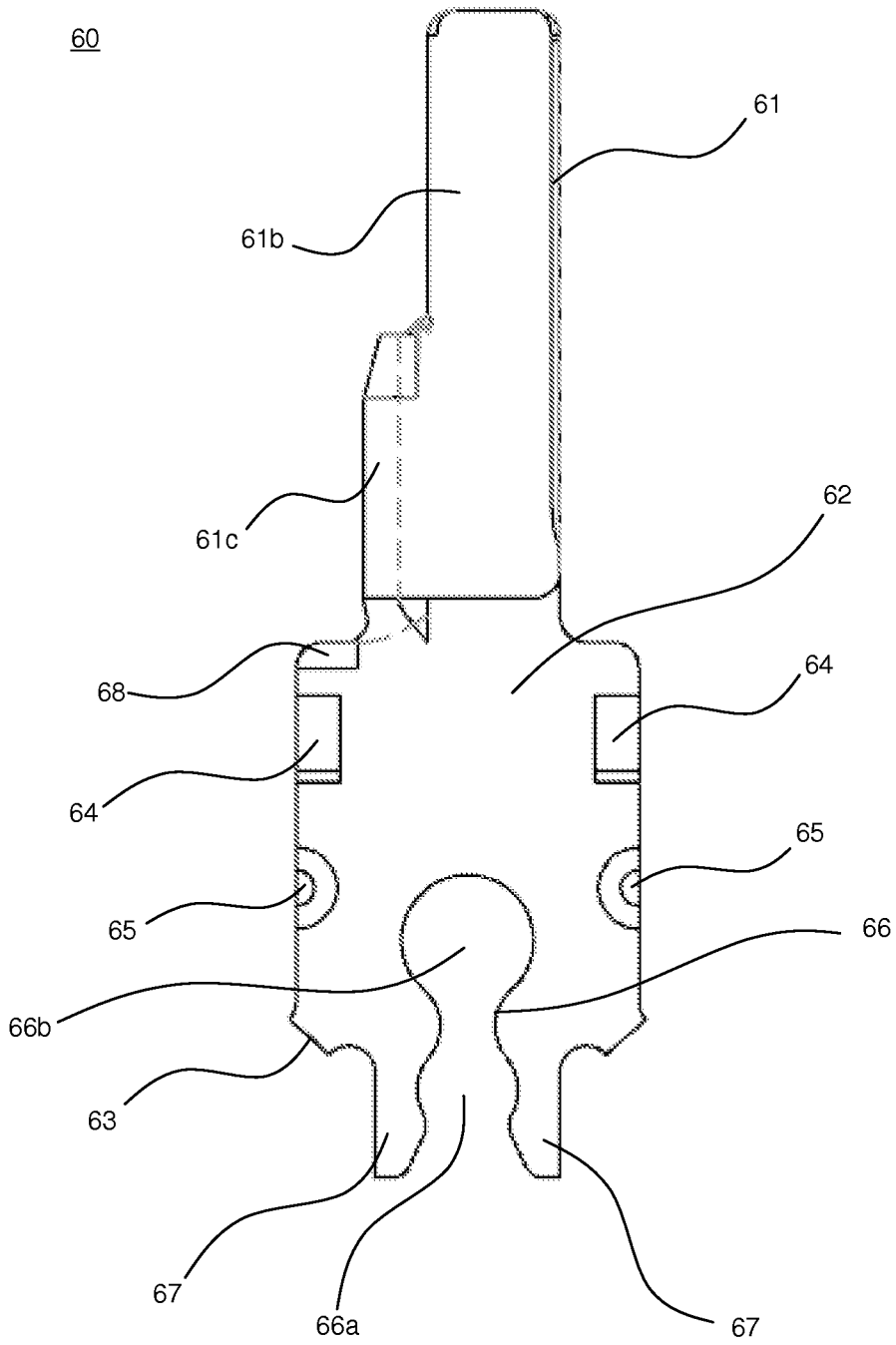
FIG. 11A is a front view of the contact shown in FIG. 10.
Figure 11B:
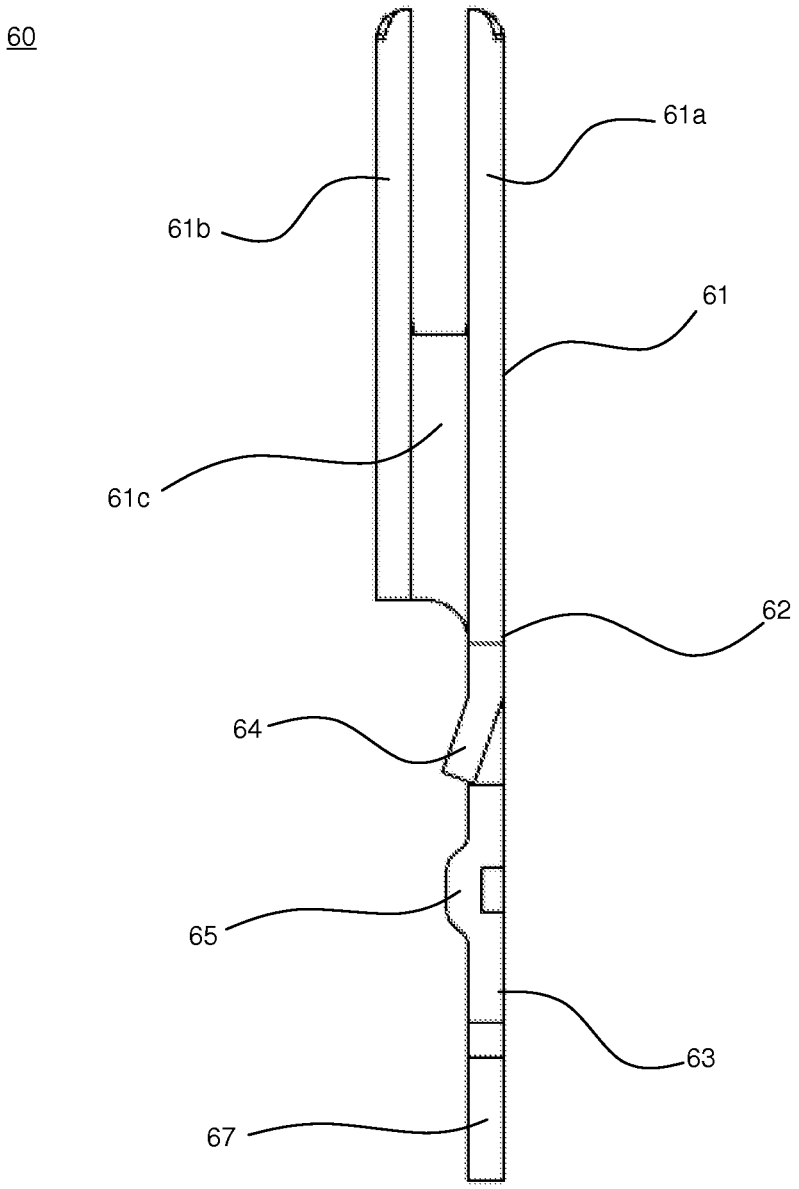
FIG. 11B is a side view of the contact shown in FIG. 10.
Figure 12:
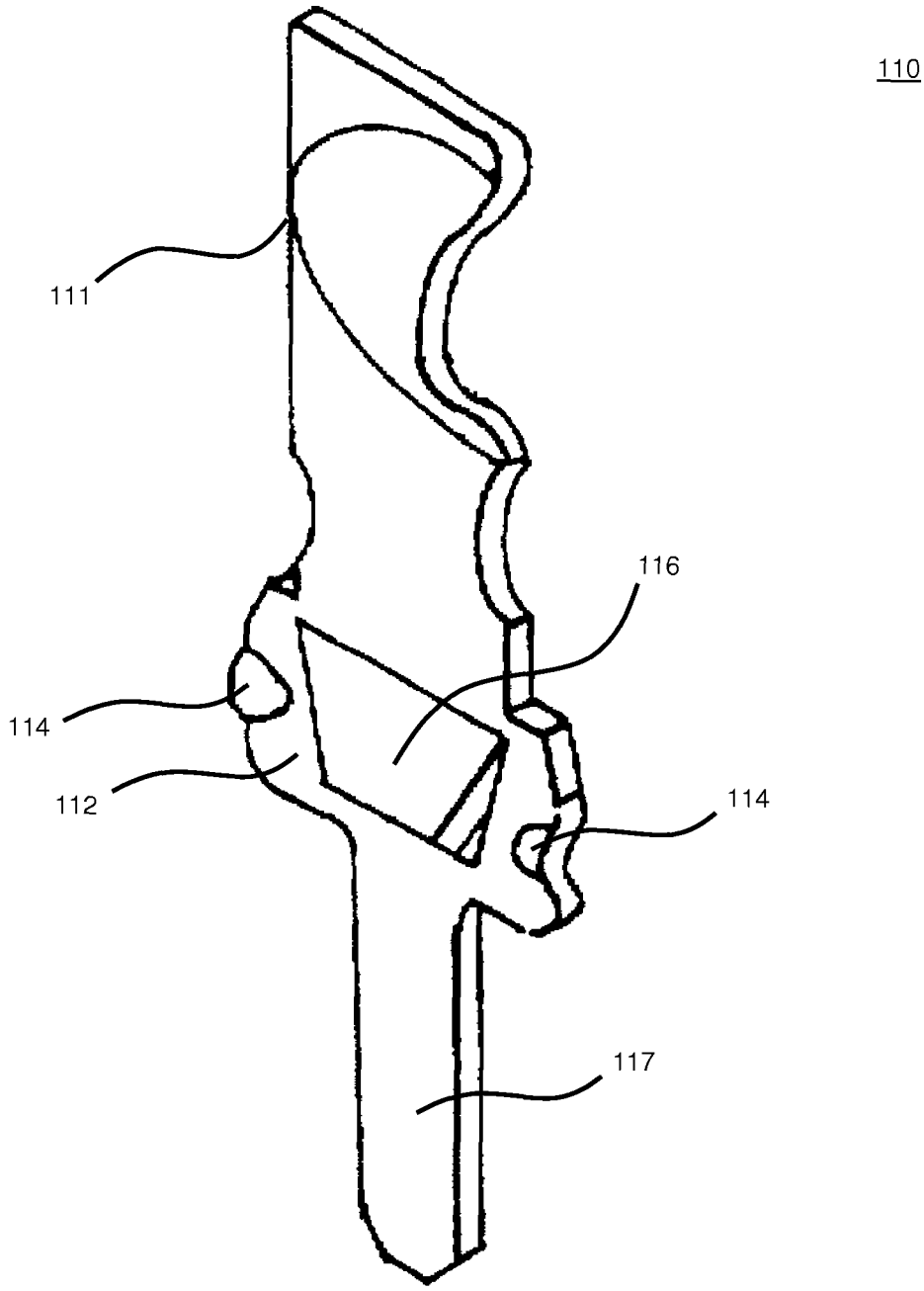
FIG. 12 PRIOR ART
FIG. 12 is a perspective view of a conventional contact.
Figure 13:
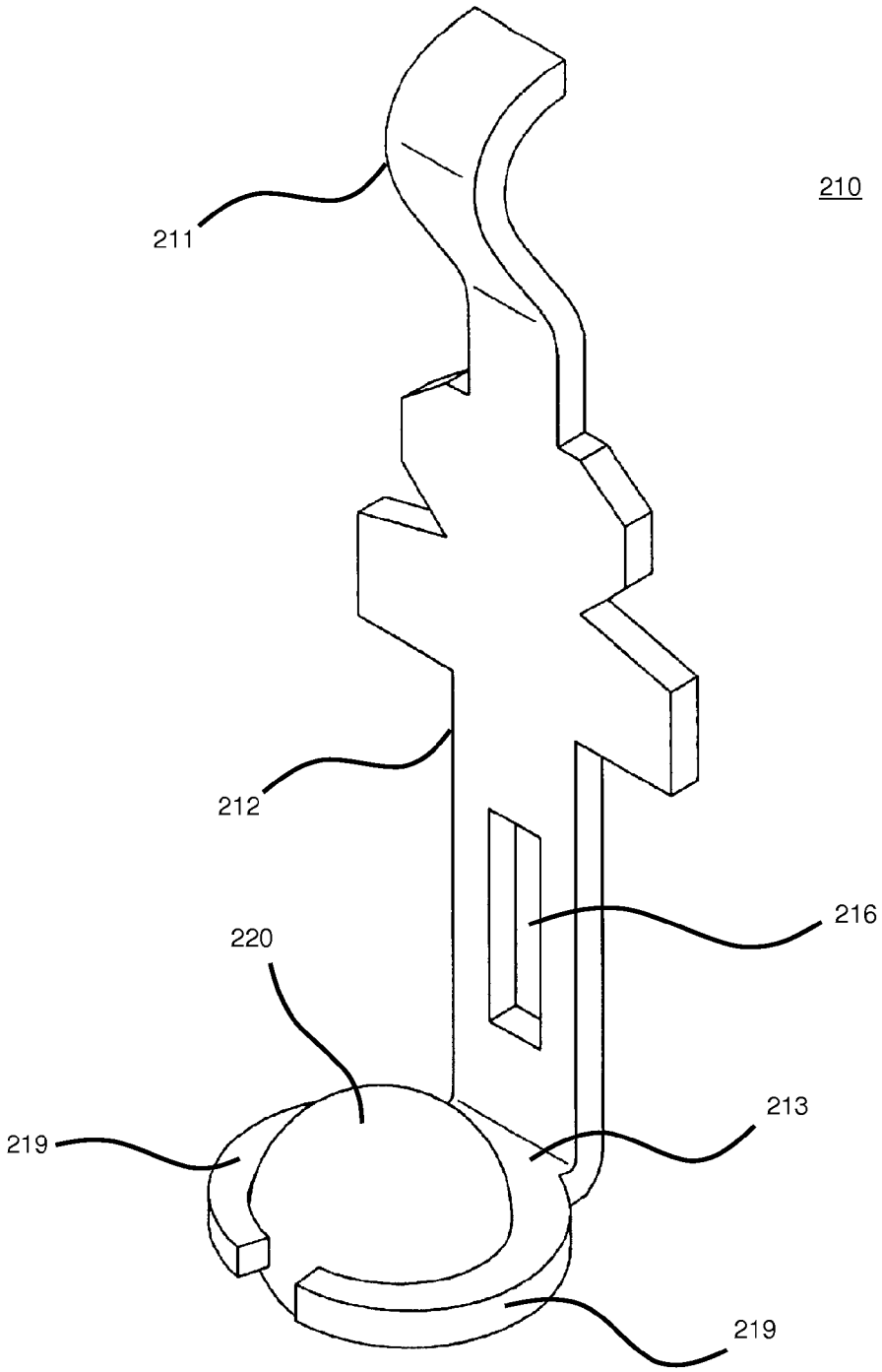
FIG. 13 PRIOR ART
FIG. 13 is a perspective view of another conventional contact.

FIGS. 10 to 11B are, respectively, a perspective view, a front view, and a side view of a contact 60 in accordance with a preferred embodiment of the present invention. As shown in FIGS. 10 to 11B, the contact 60 includes a head section 61, a body section 62, and a tail section 63. The head section 61 of the contact 60 includes a first arm 61*a*, a second arm 61*b*, and a bridge 61*c* that connects the second arm 61*b* to the first arm 61*a* so as to define a tulip connection point for the contact 60. It is noted that the solder member 20 has been omitted from FIGS. 10 to 11B for clarity, and a soldering process similar to that described above with respect to the contact 10 may be used to form a mechanical and electrical connection between the contact 60 and a printed circuit board (not shown). The contact 60 is preferably included in a male connector, and is preferably arranged to engage with a corresponding female connector similar to connector 30 as shown in FIGS. 5A to 7.

As shown in FIGS. 10 and 11A, the contact 60 includes an extended tail section 63 with two legs 67 extending therefrom. The contact 60 preferably includes an opening 66 that is similar to the opening 16 of the contact 10 shown in FIGS. 1A to 4 and the opening 56 of the contact 50 shown in FIGS. 8 to 9B.

Preferably, the contact 60 includes two lances 64 and two dimples 65 to secure the contact 60 within a connector (not shown). However, any other number of lances 64 or dimples 65 can also be used, one or more of the lances 64 may be replaced with a dimple 65, or vice-versa. The lances 64 and the dimple(s) 65 are preferably arranged to engage with the connector such that contact 60 is secured in a connector. It is also possible to use other structures, e.g., side barbs extending in the width direction of the contact 60, to secure the contact 60 in the connector. Preferably, the contact 60 also includes a recessed shoulder 68 to facilitate insertion and alignment of the contact 60 when the contact 60 is inserted into a connector.

As shown in FIGS. 10 and 11A, a fourth point of contact may be included to further secure the contact 60 to a connector, provided by the lances 64 and the dimples 65. The lances 64 and the dimples 65 are preferably arranged at or near the vertices of a square or rectangle within manufacturing tolerances. However, one or more of the lances 64 and the dimples 65 may be offset, for example, such that the lances 64 and dimples 65 are arranged at or near the vertices of a parallelogram or trapezoid within manufacturing tolerances.

Various preferred embodiments of the present invention use three or four points of contact, while conventional contacts use at most one or two points of contact. Because adding points of contact adds to the cost of manufacturing of a contact, unnecessary points of contact are not added. Although using three or four points of contact increases the cost of manufacturing the contacts 10, 50, and 60, it allows the contacts 10, 50, and 60 to be manufactured smaller than conventional contacts, while still providing a sufficient frictional, interference fit to retain the contacts 10, 50 and 60 within a connector.

As shown in FIGS. 10 and 11A, the first arm 61*a* and second arm 61*b* are preferably arranged to be flat or substantially flat, and the bridge 61*c* is preferably arranged to have a reduced cross-sectional width. Thus, the contact 60, as shown in FIGS. 10 to 11B, preferably has a smaller cross-sectional width than the contacts 10 and 50, as shown in FIGS. 3, 4, and 9. Further, a connector that includes the contact 60 may have a narrower cross-section than that of the connector 30.

Preferably, a male connector that includes the contact 60 is arranged to engage with a female connector that includes the contact 10 and/or the contact 50. In particular, the outer surfaces of the first arm 61*a* and second arm 61*b* are preferably arranged to engage with the inner surfaces of the first arm 11*a* and second arm 11*b*. Accordingly, the male connector that includes the contact 60 preferably includes clearance at the head section 61 to provide clearance for joining with the head section 11. It is noted that, while a connector that includes the contact 60 may have a narrower cross-section than that of the connector 30, the connector that includes the contact 60 preferably has a pitch similar to that of the connector 30 to ensure that the contact 60 is aligned with the contact 10 and/or the contact 50. As shown in FIGS. 1A, 1B, 3, 4, 8, and 9B, the inner surfaces of the first arm 11*a* and second arm 11*b* are preferably curved to have a convex shape. Further, as shown in FIGS. 10 and 11B, the outer surfaces of the first arm 61*a* and second arm 61*b* preferably have a flat, planar shape.

According to the preferred embodiments of the present invention, the holding sections 16*a*, 56*a*, and 66*a* and the abatement sections 16*b*, 56*b*, and 66*b* of the openings 16, 56, and 66 direct reflowed solder of the solder member 20 to the center of the bottom of the tail sections 13, 53, and 63. Accordingly, the reflowed solder of the solder member 20 is directed towards a corresponding pad on a printed circuit board to form a mechanical and electrical connection between the contact 10, 50, or 60 and the printed circuit board. The solder member 20, as shown in FIGS. 1A to 2A, 3, and 4, preferably is crimped solder that has a roughly cylindrical shape that is preferably formed by cutting the solder member 20 from a length of solder wire and then crimping the solder member 20 to the contact 10, 50, or 60. However, the arrangement of the solder member 20 is not limited thereto. For example, the solder member 20 could be solder balls attached to the contacts 10, 50, or 60 or could be solder charges that are shaped to the contour of the contact 10, 50, or 60. Further, according to the preferred embodiments of the present invention, any fusible substance may be used in place of the solder member 20.

Moreover, to help further prevent solder from wicking into the head sections 11 and 61 according to the preferred embodiments of the present invention, such as when multiple passes of reflow soldering are performed, an abatement band is preferably included in the contacts 10, 50, and 60. The abatement band is preferably formed as a narrow strip that extends horizontally across both planar surfaces of the contacts 10, 50, and 60, and is preferably located at or near an edge of the abatement sections 16*b*, 56*b*, and 66*b*. The abatement band may include scoring (for example, laser scoring) and/or a material to which solder does not adhere (e.g., nickel). The abatement band is preferably included in contacts with small dimensions or low profiles to supplement the wicking prevention provided by the abatement sections 16*b*, 56*b*, and 66*b*. Preferably, the abatement band is arranged at a predetermined distance from the bottom of the tail sections 13, 53, and 63 (i.e., the connection point between the contact 10, 50, and 60 and the corresponding pad on a printed circuit board). As one example, the abatement portion can be located directly above the opening 16, 56, or 66 and can extend across the entire width of both sides of the contact 10, 50, or 60.

The contacts 10, 50, and 60 according to the preferred embodiments of the present invention are preferably formed by stamping, for example, by progressive die stamping. Further, the lances 14 and 64 according to the preferred embodiments of the present invention are preferably formed by punching the contacts 10, 50, and 60 after stamping, for example.

The head sections 11 and 61 of the contacts 10, 50, and 60 are preferably formed as a tulip connection point defined by first arms 11*a* and 61*a* and second arms 11*b* and 61*b*. Preferably, when the contact 60 engages with the contact 10 or the contact 50, the outer surfaces of the first arm 61*a* and second arm 61*b* engage with the inner surfaces of the first arm 11*a* and second arm 11*b*, thereby providing two connection points between the contact 60 and the contact 10 or the contact 50. Accordingly, the tulip connection point defined by first arms 11*a* and 61*a* and second arms 11*b* and 61*b* provides:

1) redundant connections between the contact 60 and the contact 10 or the contact 50;
2) a more secure mechanical and electrical connection between the contact 60 and the contact 10 or the contact 50;
3) resilience to mechanical stresses (e.g., vibration or shock); and
4) a large contact area between the contact 60 and the contact 10 or the contact 50, which allows, for example, the connection between the contact 60 and the contact 10 or the contact 50 to transmit power.

However, the arrangement of the contacts 10, 50, and 60 is not limited to the above configuration. For example, the contacts 10, 50, and 60 may include only a single arm (e.g., first arms 11*a* and 61*a*, with the second arms 11*b* and 61*b* and the bridges 11*c* and 61*c* omitted). Further, the contacts 10, 50, and 60 may include more than two arms, and the contacts 10, 50, and 60 may include other geometries according to application-specific design requirements.

The contacts 10, 50, and 60 according to the preferred embodiments of the present invention preferably include a copper alloy base and plating formed of tin, a tin alloy (e.g., a tin-lead alloy), gold, or a gold alloy at the head section and tail section (e.g., sections of the contact that may directly connect to a corresponding contact, a printed circuit board, or other electrical device). Further, the abatement band may include nickel, a nickel alloy, a wax, or similar substance that solder does not adhere to. The connector 30 according to the preferred embodiments of the present invention is preferably made from an insulating material, for example, any plastic, thermoplastic, rubber, or similar non-metallic material.

As shown in FIGS. 5A to 7, the connector 30 according to a preferred embodiment of the present invention may include six rows of contacts 10, for example. However, the arrangement of the connector 30 is not so limited. For example, the contacts 50 and 60 may be used in place of, or in addition to, the contacts 10. Further, only a single row of contacts 10, 50, and/or 60 may be included in the connector 30, or any number of rows (e.g., two, four, eight, etc.) of contacts 10, 50, and/or 60 may be included in the connector 30. Further, spacing between adjacent ones of the contacts 10, 50, and 60 may be adjusted according to positioning of ground contacts, to include high-voltage contacts, or other design requirements.

As shown in FIGS. 5A to 7, the connector 30 according to a preferred embodiment of the present invention is preferably a low-profile array connector. However, the contacts 10, 50, and 60 may be used in any type of connector to help maintain secure positioning of the contacts 10, 50, and 60 while increasing contact density or reducing pitch spacing.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A contact comprising:

a head;

a tail including an opening;

a body connected at one end thereof to the head and at another end thereof to the tail;

a first lance and a second lance extending from the body;

a dimple raised from the body; and a solder member attached to the tail such that the solder member engages at least a portion of the opening; wherein the first lance and the second lance are arranged to deflect when the contact is inserted into a connector;

the first lance, the second lance, and the dimple are arranged to frictionally secure the contact to the connector; and the first lance, the second lance, and the dimple are arranged so as not to be co-linear so that a line connecting any two of the first lance, the second lance, and the dimple does not intersect with a third of the first lance, the second lance, and the dimple.

2. The contact according to claim 1, wherein the solder member is crimped to the tail.

3. The contact according to claim 1, wherein:

the opening includes a holding section at an end of the tail opposite to the body; and the solder member is attached to the tail such that the solder member fills the holding section.

4. The contact according to claim 1, wherein:

the opening includes an abatement section extending in a direction of the body; and the solder member is attached to the tail such that the solder member does not engage with the abatement section before the solder member is reflowed.

5. The contact according to claim 1, wherein the abatement section is arranged such that the solder member reflows into the abatement section when the solder member is reflowed.

6. The contact according to claim 1, wherein:

the first lance, the second lance, and the dimple are arranged to be equidistant or substantially equidistant.

7. The contact according to claim 1, wherein:

the tail includes a first leg and a second leg extending therefrom;

a space between the first leg and the second leg defines at least a portion of the opening; and the solder member is attached to the first leg and the second leg.

8. The contact according to claim 1, further comprising a second dimple.

9. The contact according to claim 8, wherein:

the first lance, the second lance, the dimple, and the second dimple are arranged at or substantially at vertices of a square or rectangle.

10. The contact according to claim 8, wherein:

the first lance, the second lance, the dimple, and the second dimple are arranged at or substantially at vertices of a parallelogram or trapezoid.

11. The contact according to claim 1, further comprising an abatement band extending across each of an opposing pair of major surfaces of the contact.

12. The contact according to claim 11, wherein the abatement band is formed either by depositing a material that solder does not adhere to on the major surfaces of the contact or by scoring the major surfaces of the contact.

13. A connector comprising at least one contact according to claim 1.

14. A connector according to claim 13, wherein the at least one contact includes a plurality of contacts.

15. A connector according to claim 13, wherein the head of the at least one contact is arranged to engage with a corresponding contact of another connector.

16. A connector according to claim 13, wherein the solder member of the at least one contact is arranged to be fused to the tail of the at least one contact and to be fused with a pad on a printed circuit board.

17. A contact comprising:

a head;

a tail including a continuous opening with a holding section and an abatement section;

a body connected at one end thereof to the head and at another end thereof to the tail; and a solder member attached to the tail such that the solder member engages the holding section; wherein the abatement section is spaced away from the holding section such that the solder member is not in contact with the abatement section before being reflowed and such that the solder member reflows into the abatement section when the solder member is reflowed.

18. The contact according to claim 17, wherein the abatement section is arranged to have a volume proportional to a volume of the solder member.

* * * * *